US006675427B1

(12) United States Patent
Chiapelli et al.

(10) Patent No.: US 6,675,427 B1
(45) Date of Patent: Jan. 13, 2004

(54) MOP INCLUDING A MOP HEAD HAVING A SCRUB MATERIAL

(75) Inventors: Andrea Chiapelli, Trenton, OH (US); Christopher J. Laux, Hamilton, OH (US)

(73) Assignee: O-Cedar Brands, Inc., Springfield, OH (US)

( * ) Notice: Subject to any disclaimer, the term of this patent is extended or adjusted under 35 U.S.C. 154(b) by 51 days.

(21) Appl. No.: 10/113,000

(22) Filed: Mar. 29, 2002

(51) Int. Cl.[7] ..... A47L 13/12; A47L 13/142
(52) U.S. Cl. ..... 15/120.1; 15/118; 15/229.2
(58) Field of Search ..... 15/118, 120.1, 15/229.2

(56) References Cited

U.S. PATENT DOCUMENTS

| | | | | |
|---|---|---|---|---|
| 780,945 | A | | 1/1905 | Fenton |
| 1,840,189 | A | | 1/1932 | Dwork |
| 2,482,163 | A | * | 9/1949 | Finnell |
| 2,893,029 | A | * | 7/1959 | Vosbikian |
| 3,399,499 | A | | 9/1968 | Stetz |
| 3,533,122 | A | | 10/1970 | Hesener |
| 4,264,337 | A | | 4/1981 | Fenster et al. |
| 4,523,347 | A | | 6/1985 | Tames |
| 4,675,932 | A | | 6/1987 | Hofacker, Jr. |
| 4,964,186 | A | | 10/1990 | Stuck |
| 5,577,290 | A | * | 11/1996 | Monahan |
| 5,615,442 | A | | 4/1997 | Schroeck et al. |
| 5,848,451 | A | | 12/1998 | Barnett |
| 5,875,509 | A | | 3/1999 | Facca |
| 5,896,613 | A | * | 4/1999 | Courtney |
| 5,918,340 | A | | 7/1999 | Young |
| 5,996,161 | A | | 12/1999 | Facca |
| 6,085,378 | A | | 7/2000 | Petner |
| 6,105,193 | A | | 8/2000 | Williams et al. |
| 6,253,408 | B1 | * | 7/2001 | Feld |

* cited by examiner

*Primary Examiner*—Randall E. Chin
(74) *Attorney, Agent, or Firm*—Calfee, Halter & Griswold LLP

(57) ABSTRACT

The present invention relates to a mop having a mop head supported on a handle and including a mop head base and a mop body. The mop body is defined by a plurality of mop strands supported on the base. A scrubber element is supported on the base, centrally within the mop body. The scrubber element further has opposing faces on a scrubber body located at laterally opposing sides to define abrasive scrubbing surfaces. A single attachment element provides a simple and cost-effective way to attach the scrubber element simultaneously with attachment of the mop strands. The scrubber element further is engaged with the mop head base to bias the scrubber element into a folded configuration folded so that the opposing faces are facing away from the mop handle thereby enabling a mop user to easily manipulate the scrubber element provided for removal of difficult stains, etc., by applying downward pressure to the handle.

24 Claims, 7 Drawing Sheets

PRIOR ART

MOP INCLUDING A MOP HEAD HAVING A SCRUB MATERIAL

FIELD OF THE INVENTION

The present invention relates generally to mops and, more particularly, to mops including a mop head formed by mop strands and incorporating an abrasive scrubber element.

BACKGROUND OF THE INVENTION

In conventional wringer mops, as well as string-type or yacht-type mops, a mop body for the mop is formed from a plurality of strands, such as yarn strands. These mops are well known and, typically, are used either in cleaning the floor of loose materials, stains and dirt, or in removing fluids from a floor surface.

If a stain, scuff mark, or spot of finish residue is encountered during a cleaning, it is also known to use these mops to remove the stain, etc., by pressing downward on the handle of the mop to exert a force on the strands, as well as on the head band, and moving the mop back and forth in the hopes of removing the stain. Oftentimes, the mop strands fail in removing these stains, scuff marks, etc., due to the lack of an abrasive. Also, such scrubbing action may contribute to the rapid deterioration of the head band and mop yarns.

Attempts have been made to improve the utility of these types of mops by incorporating a type of scrubber element having an abrasive scrubbing surface on the mop to be used in conjunction with the mop strands.

However, some of these mops contain abrasive scrubber elements located in inconvenient places wherein the user must operate the mop by holding it at an awkward angle while applying pressure thereto. Additionally, these mops may include a number of various attachment parts to hold the scrubber element in place thereby adding to the overall cost of the mop.

While most of the mops having mop strands that incorporate an abrasive scrubbing element effectively work for their intended purpose, it is desirable to assemble mops wherein the scrubber element quickly and easily can be installed during assembly of the mop.

Notably, the mop of the present invention provides a quick and easy way to attach a scrubber element by placing the scrubber element onto a single attachment element prior to attachment to the mop handle. Further, the single attachment element of the present invention provides a simple way to attach the scrubber element simultaneously with attachment of the mop strands, and provides such a construction while keeping the cost of the mop down due to the minimal number of parts associated therewith.

Additionally, the mop user is able to easily manipulate the scrubber element provided by the present invention for removal of difficult stains, etc., by applying downward pressure to the handle. While pressure is applied to the handle and the mop moved back and forth, the scrubber element is able to maintain a high degree of compressiveness and, thus, adaptability to variations and irregularities in floor contour making the overall cleaning operation simpler for the user.

SUMMARY OF THE INVENTION

The present invention provides a mop of the type including a mop head formed by a mop head base and a mop body formed by mop strands and incorporating an abrasive scrubber element. The scrubber element is formed of a compressive material, preferably a compressive open cell polyether foam material, having abrasive scrubbing surfaces preferably made from a non-woven abrasive material.

The mop further includes a single attachment element which receives the scrubber element and mop strands prior to assembly to the mop handle. The attachment element then can be simply and securely received within the mop head base for holding the scrubber element and mop strands in place on the mop handle. In a preferred embodiment, the attachment element comprises a generally U-shaped element having end portions received within the mop head base.

The mop head base is provided with an engagement surface located in engagement with the scrubber element to bias the scrubber element into a folded configuration while the scrubber element is secured to the mop so that the scrubbing surfaces face away from the mop handle. In this way, the mop user can manipulate the scrubber element for removal of difficult stains, etc., by applying downward pressure to the handle.

Accordingly, it is an object of the invention to provide a quick and easy way to attach a scrubber element by placing the scrubber element onto a single attachment element prior to attachment to the mop handle.

It is another object of the invention to provide a simple way to attach a scrubber element simultaneously with attachment of mop strands, and providing such a construction while keeping the cost of the mop down due to the minimal number of parts associated therewith.

Lastly, it is another object of the invention to provide a scrubber element that is able to maintain a high degree of compressiveness and, thus, adaptability to variations and irregularities in floor contour making the overall cleaning operation simpler for the user.

The invention will be further described in conjunction with the appended drawings and following detailed description.

DETAILED DESCRIPTION OF THE PREFERRED EMBODIMENTS

FIGS. 1–10 show the present invention which concerns an improvement over a mop of the type disclosed in U.S. Pat. No. 5,615,442 to Schroeck et al. hereby incorporated by reference herein, which discloses an improved connector for connecting mop strands to a mop handle.

Figure 1:
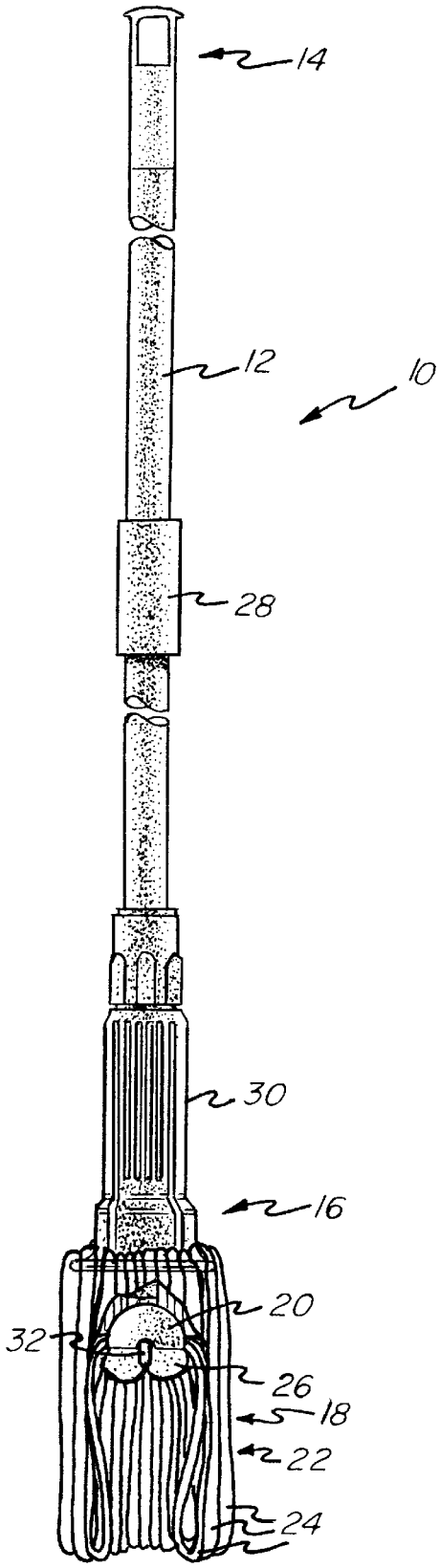
FIG. 1 is a side elevational view of a mop partially cut away to show an abrasive scrubber element incorporated into the mop head of the present invention.

As best shown in FIG. 1, the mop 10 includes a handle 12 having opposing upper and lower ends 14, 16 and a mop head 18 formed by a mop head base 20 and a mop body 22 having mop strands 24 wherein an abrasive scrubber element 26 has been incorporated within the mop body 22. Additionally, a padded hand grip 28 may be provided along the handle 12 and a sleeve 30 mounted for sliding movement along the handle 12 and attached to a portion of the strands 24 so that sliding and twisting movement of the sleeve 30 may be performed to wring out fluids (not shown) from the strands 24 in a conventional manner.

In FIG. 1, the mop head base 20 is shown attached to the lower end 16 of the handle 12 and the mop body 22 is defined by a plurality of mop strands 24 supported on the base 20. The scrubber element 26, likewise, is supported on the base 20, centrally within the mop body 22. The mop strands 24 and scrubber element 26 are supported on the base 20 by a single attachment element 32 which provides a simple way to attach the scrubber element 26 simultaneously with attachment of the mop strands 24 to the mop 10 while keeping the cost of the mop 10 down due to the minimal number of parts associated therewith.

Figure 2:
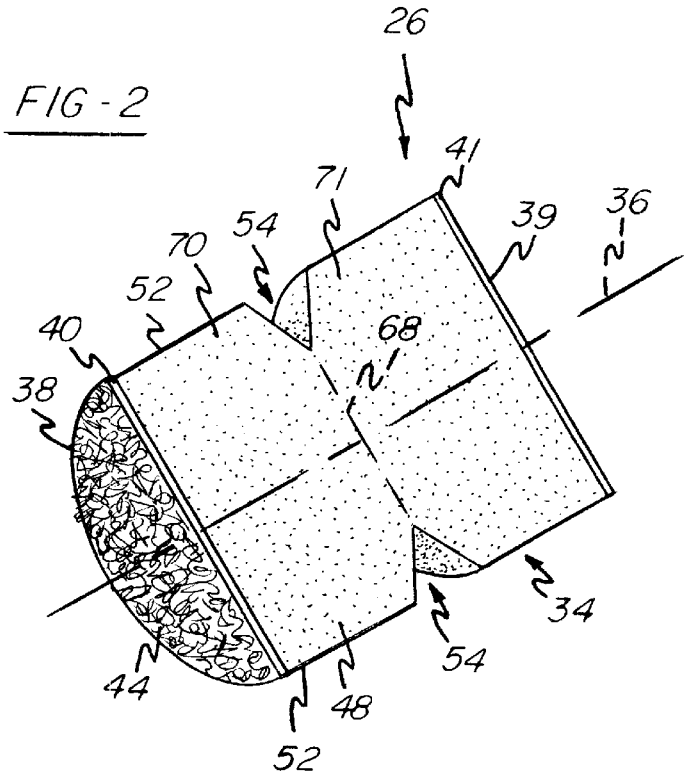
FIG. 2 is a perspective view of the abrasive scrubber element as shown in FIG. 1 prior to incorporation.
Figure 3:
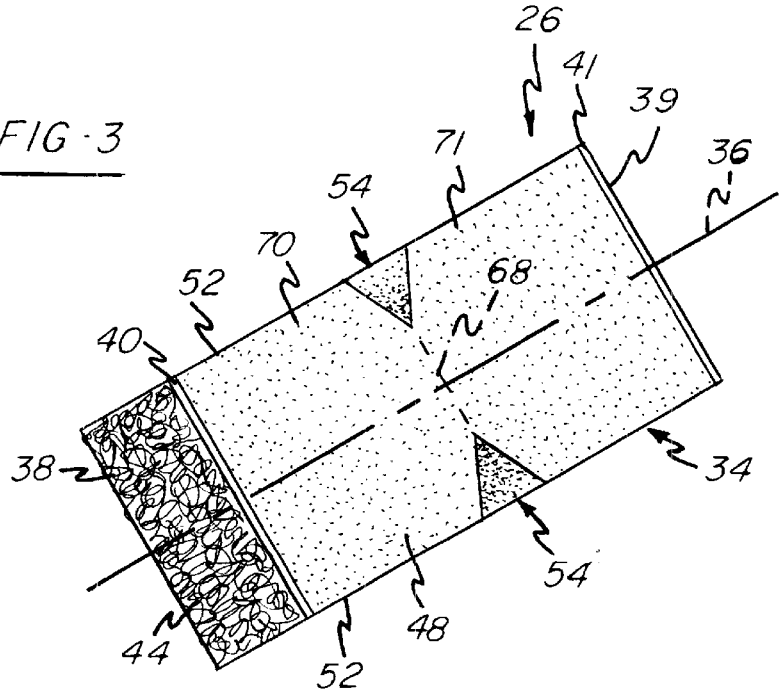
FIG. 3 is a perspective view of another embodiment of the abrasive scrubber element of the present invention.

In FIGS. 2 and 3, two embodiments of an abrasive scrubber element 26 of the present invention are illustrated. Although, FIG. 2 is shown as being substantially semi-circular in shape and FIG. 3 is shown as being substantially rectangular in shape, the artisan will appreciate that other shapes could be substituted.

As shown in FIGS. 2 and 3, each scrubber element 26 comprises a scrubber body 34 defining a longitudinal axis 36 and opposing faces 38, 39 located at laterally opposing sides 40, 41 of the scrubber body 34. The scrubber body 34 is formed of a compressible material, preferably an open cell polyether foam material, while the opposing faces 38, 39 define abrasive scrubbing surfaces 44 preferably comprised of a non-woven abrasive material.

Figure 7:
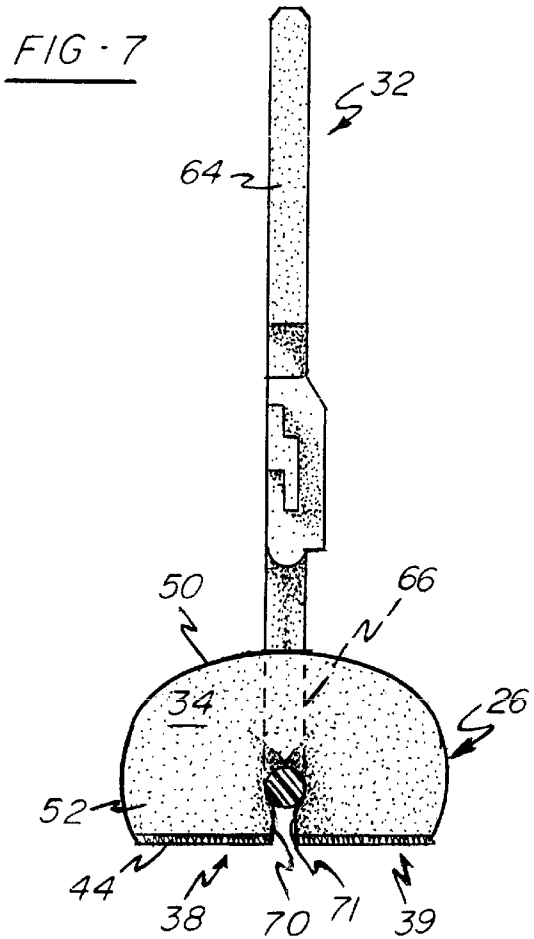
FIG. 7 is a side elevational view of the attachment element from FIG. 1, without the mop head base, and with the abrasive scrubber element from FIG. 3 situated therearound in a folded configuration
Figure 6:
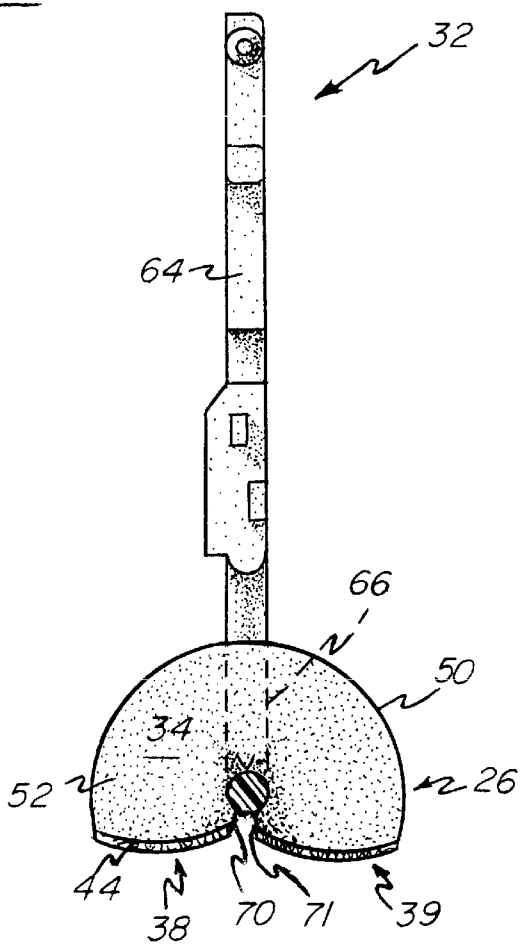
FIG. 6 is a side elevational view of the attachment element from FIG. 1, without the mop head base, and with the abrasive scrubber element from FIG. 2 situated therearound in a folded configuration.

Referring additionally to FIGS. 6 and 7, each scrubber element 26 further has an inner and outer longitudinal surface 48, 50 extending between the opposing faces 38, 39 and includes opposing longitudinal side surfaces 52 extending between the inner longitudinal surface 48 (FIGS. 2 and 3) and outer longitudinal surface 50. Each longitudinal side surface 52 further has a notch 54 formed therein, preferably intermediate each longitudinal side surface 52.

Figure 4:
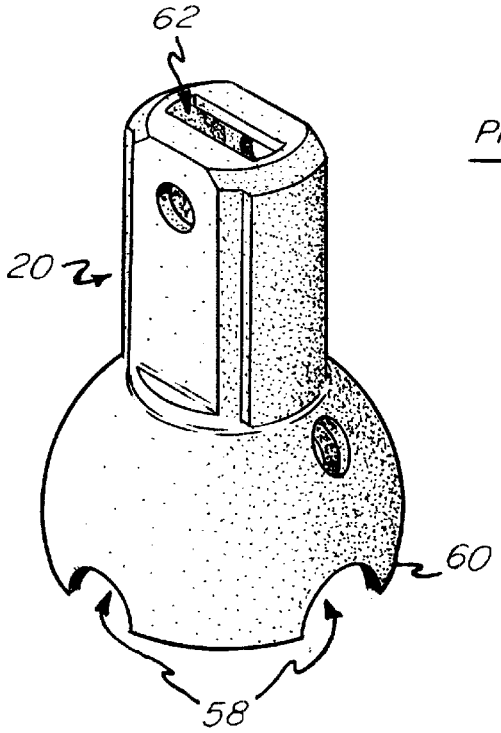
FIG. 4 is a perspective view of the mop head base from FIG. 1.
Figure 5:
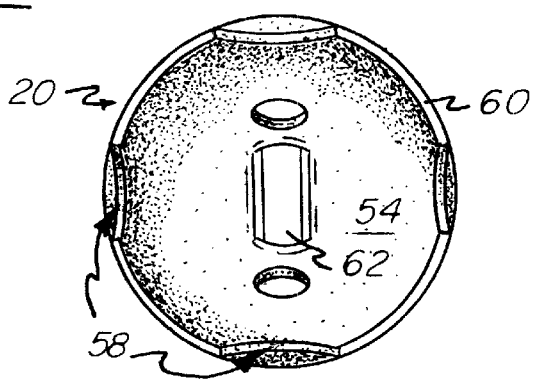
PRIOR ART FIG - 5
FIG. 5 is a bottom plain view of the mop head base from FIG. 1.

As best shown in FIGS. 4 and 5, the mop head base 20 is provided with an engagement surface 54. The engagement surface 54 engages the outer longitudinal surface 50 and biases the scrubber element 26 into a folded configuration (FIGS. 8 and 9) as the scrubber clement 26 is supported on the base 20. The base 20 further is provided with a plurality of semi-circular cut-outs 58 located at the bottom 60 thereof to create room for the mop strands 24 so that the strands 24 extend around the outer longitudinal surface 50 of the scrubber element 26 when the mop strands 24 and scrubber element 26 are supported on the base 20 (FIG. 1). The sizes, as well as the shapes, of the cut-outs 58 can vary depending upon the amount of space needed for the mop strands 24. The mop head base 20 also is provided with a hollow central portion 62 to receive the end portions 64 (FIG. 8) of the attachment element 32 which supports the scrubber element 26 and mop strands 24 on the base 20.

Figure 8:
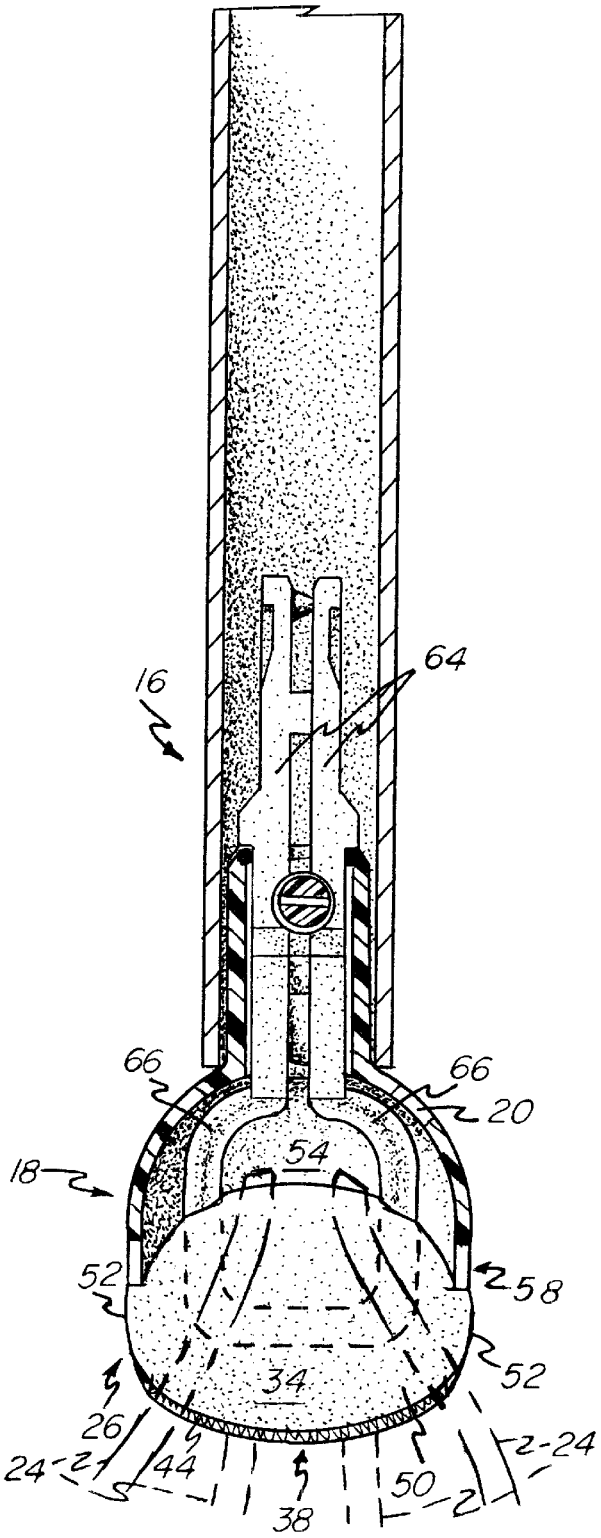
FIG. 8 is a fragmentary cross-sectional view illustrating the assembled mop from FIG. 1 including the mop head having a couple mop strands shown in phantom and incorporating the abrasive scrubber element.

As shown in FIG. 8, the attachment element 32 is generally U-shaped and has end portions 64 for being securely received within the hollow central portion 62 of the mop head base 20. The artisan will appreciate other attachment elements having a member for looping around the scrubber element 26 may be substituted for the attachment element 32 having a U-shape. The legs 66 of the attachment element are further shown extending in engagement with the notches 54 in the scrubber element 26 to hold the scrubber element 26 engaged within the base 20. In FIG. 6, the scrubber element 26 from FIG. 2 is shown in a folded configuration folded over the legs 66 while FIG. 7 shows the abrasive scrubber element 26 from FIG. 3 in a folded configuration folded over the legs 66. As may best be seen in FIG. 8, the legs 66 of the attachment element 32 also hold the mop strands 24 (shown in phantom) in position on the base 20.

Figure 9:
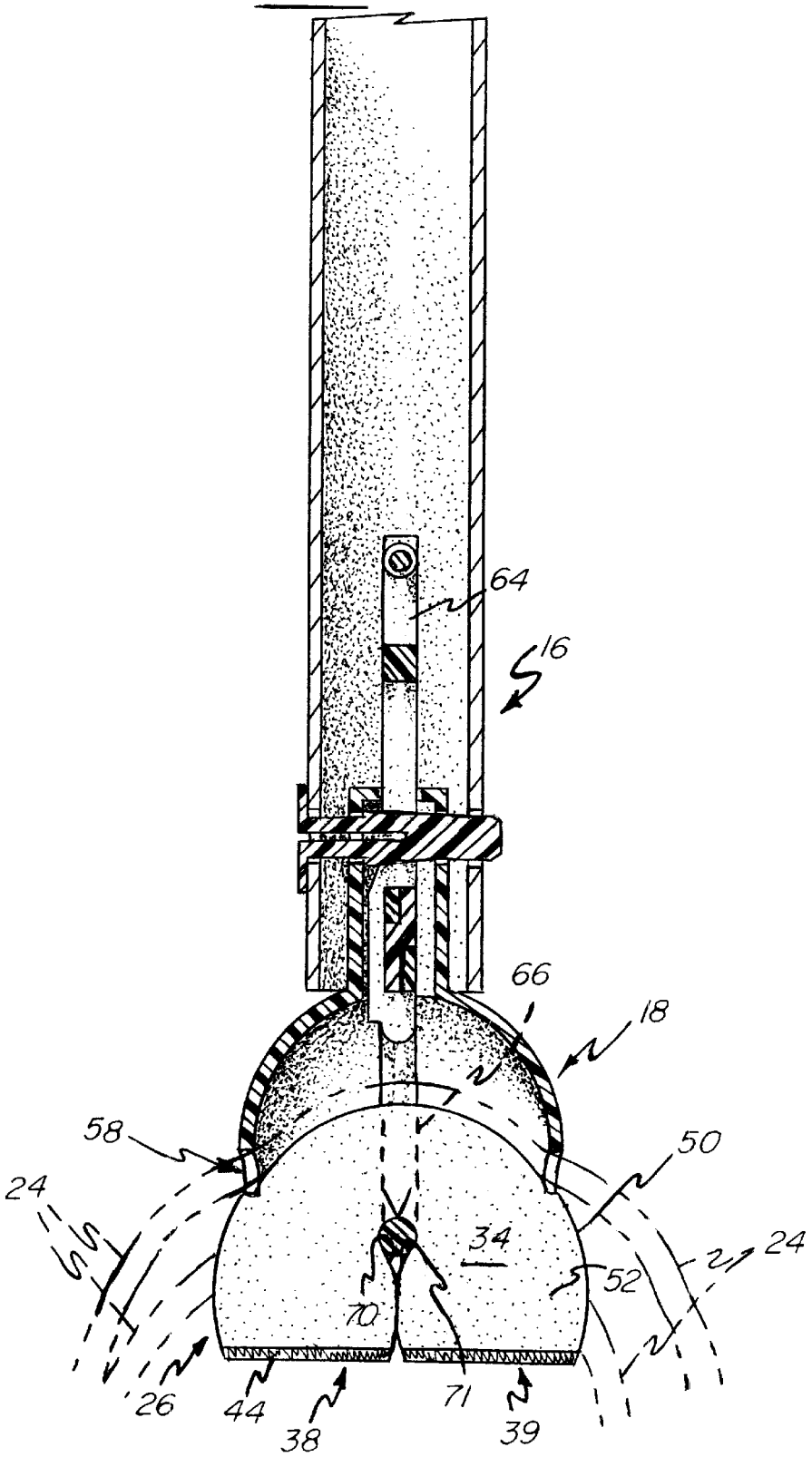
FIG. 9 is a fragmentary cross-sectional view illustrating the assembled mop, and taken perpendicular to the view of FIG. 8.

Referring to FIGS. 8 and 9, assembly of the mop head 18 includes engaging the mop strands 24 and scrubber element 26 by the legs 66 of the attachment element 32, and the end portions 64 of the attachment element 32 are securely received within the hollow central portion 62 of the mop head base 20 such that the attachment element 32 is received therein. When assembling the mop strands 24 and scrubber element 26 onto the attachment element 32, the mop strands 24 are placed over the outer longitudinal surface 50 of the scrubber element 26 so that the scrubbing surfaces 44 of the scrubber element 26 are not obstructed by the mop strands 24 (FIG. 1).

Figure 10:
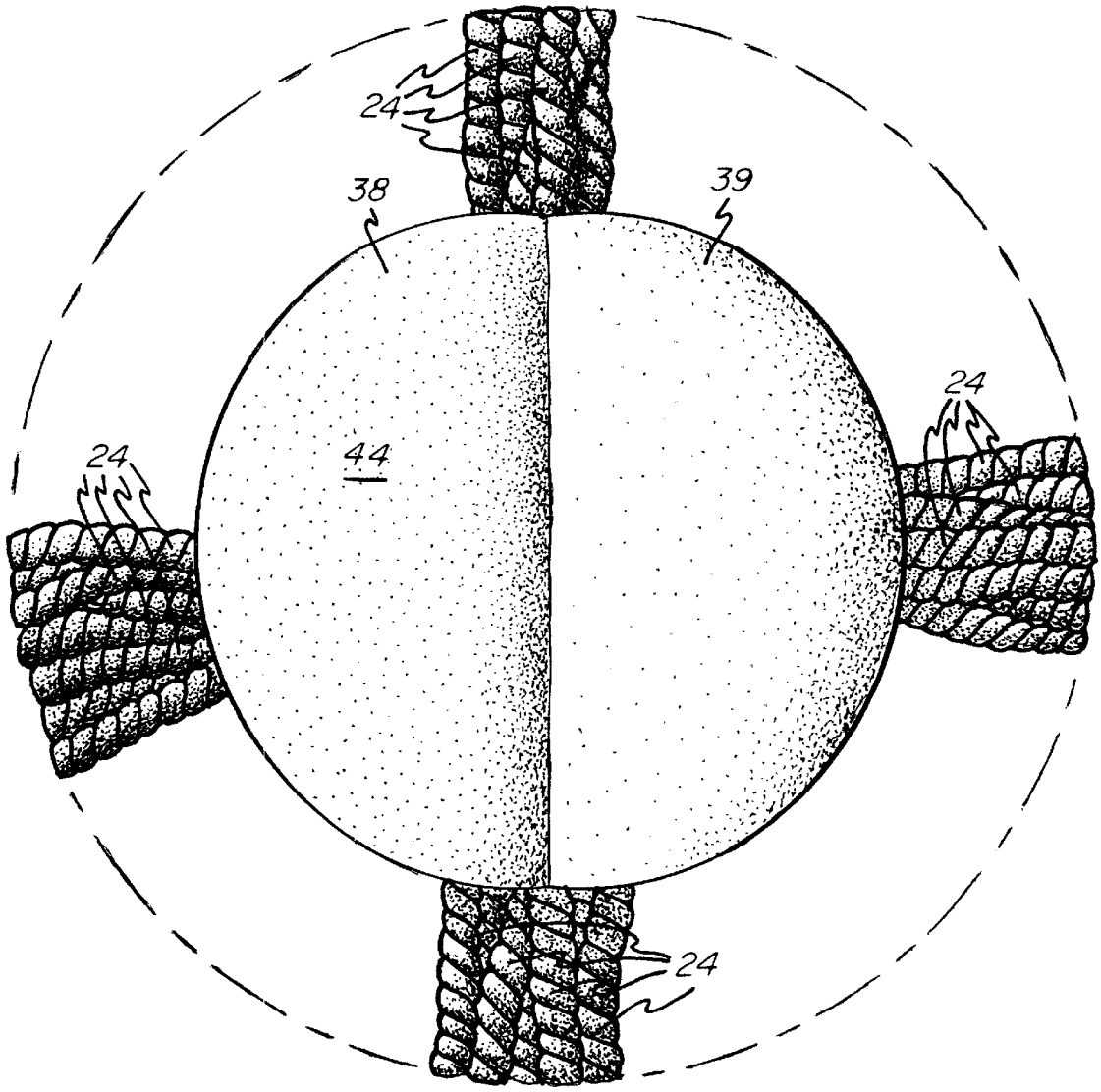
FIG. 10 is a bottom plan view illustrating the assembled mop shown in FIG. 9 with the mop strands partially cut away.

As further shown in FIGS. 8 and 9, the outer longitudinal surface 50 of the scrubber element 26 engages with the engagement surface 54 to bias the scrubber element 26 into a folded configuration about an axis 68 (FIGS. 2 and 3) perpendicular to the longitudinal axis 36 whereby the inner longitudinal surface 48 defines opposing surfaces 70, 71 in facing relation to each other and the opposing faces 38, 39 are facing away from the lower end 16 of the handle 12 and located substantially adjacent each other (see also FIG. 10).

Accordingly, the single attachment element 32 of the present invention provides a simple way to attach the scrubber element 26 simultaneously with attachment of the mop strands 24, and providing such a construction while keeping the cost of the mop 10 down due to the minimal number of parts associated therewith. After assembly, the mop user is able to easily manipulate the scrubber element 26 provided by the present invention for removal of difficult stains, etc., by applying downward pressure to the handle 12. While pressure is applied to the handle 12 and the mop 10 moved back and forth, the scrubber element 26 is able to maintain a high degree of compressiveness and, thus, adaptability to variations and irregularities in floor contour making the overall cleaning operation simpler for the user.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A mop comprising:

a handle having opposing upper and lower ends;

a mop head including a mop head base and a mop body, said mop head base attached to said lower end of said handle, said mop body defined by a plurality of mop strands supported on said base;

a scrubber element supported on said base, centrally within said mop body, said scrubber element comprising a scrubber body defining a longitudinal axis and opposing faces on said scrubber body located at laterally opposing sides of said scrubber body, said opposing faces defining abrasive scrubbing surfaces for said scrubber element; and wherein said scrubber element is in a folded configuration folded about an axis perpendicular to said longitudinal axis whereby said opposing faces are facing away from said lower end of said handle.

2. A mop as recited in claim 1 including an attachment element extending between said scrubber element and said base to hold said scrubber element in position on said base.

3. A mop as recited in claim 1 wherein said scrubber element includes an inner longitudinal surface extending between said opposing faces, said inner longitudinal surface defining opposing surfaces in facing relation to each other in said folded configuration.

4. A mop as recited in claim 3 including an attachment element engaged with said inner longitudinal surface and attached to said base to hold said scrubber element in position on said base.

5. A mop as recited in claim 4 wherein said scrubber element includes an outer longitudinal surface extending between said opposing faces, and said base includes an engagement surface located in engagement with said outer longitudinal surface to bias said scrubber element into said folded configuration.

6. A mop as recited in claim 5 wherein said scrubber element comprises opposing longitudinal side surfaces extending between said inner longitudinal surface and said outer longitudinal surface, each said longitudinal side surface further having a notch formed therein, said attachment element including legs extending in engagement with said notches.

7. A mop as recited in claim 4 wherein said attachment element comprises a generally U-shaped element having end portions attached to said base.

8. A mop as recited in claim 7 wherein said base includes a hollow central portion, said end portions being secured within said hollow central portion.

9. A mop as recited in claim 7 wherein said attachment element holds said mop strands in position on said base.

10. A mop as recited in claim 1 wherein said opposing faces are located substantially adjacent each other in said folded configuration.

11. A mop as recited in claim 1 wherein said scrubber body is formed of a compressible material.

12. A mop as recited in claim 11 wherein said scrubber body is formed of a foam material.

13. A mop as recited in claim 12 wherein said scrubber body comprises an open cell polyether foam material.

14. A mop as recited in claim 1 wherein said scrubbing surfaces comprise a non-woven abrasive material attached to said scrubber body.

15. A mop comprising:

a handle having opposing upper and lower ends;

a mop head including a mop head base and a mop body, said mop head base attached to said lower end of said handle and having an engagement surface, said mop body defined by a plurality of mop strands supported on said base;

a scrubber element supported on said base, centrally within said mop body, said scrubber element comprising a scrubber body defining a longitudinal axis and opposing faces on said scrubber body located at laterally opposing sides of said scrubber body, said opposing faces defining abrasive scrubbing surfaces for said scrubber element, said scrubber element further including an inner and outer longitudinal surface extending between said opposing faces; and wherein said outer longitudinal surface of said scrubber element is engaged with said engagement surface to bias said scrubber element into a folded configuration folded about an axis perpendicular to said longitudinal axis whereby said inner longitudinal surface defines opposing surfaces in facing relation to each other and said opposing faces are facing away from said lower end of said handle.

16. A mop as recited in claim 15 including an attachment element engaged with said inner longitudinal surface and attached to said base to hold said scrubber element in position on said base.

17. A mop as recited in claim 16 wherein said scrubber element comprises opposing longitudinal side surfaces extending between said inner longitudinal surface and said outer longitudinal surface, each said longitudinal side surface further having a notch formed therein, said attachment element including legs extending in engagement with said notches.

18. A mop as recited in claim 16 wherein said attachment element comprises a generally U-shaped element having end portions attached to said base.

19. A mop as recited in claim 18 wherein said base includes a hollow central portion, said end portions being secured within said hollow central portion.

20. A mop as recited in claim 18 wherein said attachment element holds said mop strands in position on said base.

21. A mop as recited in claim 15 wherein said opposing faces are located substantially adjacent each other in said folded configuration.

22. A mop as recited in claim 15 wherein said scrubber body comprises an open cell polyether material.

23. A mop as recited in claim 15 wherein said scrubbing surfaces comprise a non-woven abrasive material attached to said scrubber body.

24. A mop comprising:

a handle having opposing upper and lower ends;

a mop head including a mop head base and a mop body, said mop head base attached to said lower end of said handle and having an engagement surface and a hollow central portion, said mop body defined by a plurality of mop strands supported on said base;

a scrubber element supported on said base, centrally within said mop body, said scrubber element comprising a scrubber body defining a longitudinal axis and opposing faces on said scrubber body located at laterally opposing sides of said scrubber body, said opposing faces defining abrasive scrubbing surfaces for said scrubber element, said scrubber element further including an inner and outer longitudinal surface extending between said opposing faces and opposing longitudinal side surfaces extending between said inner longitudinal surface and said outer longitudinal surface, each said longitudinal side surface further having a notch formed therein;

an attachment element being generally U-shaped, having end portions secured within said hollow portion of said base, and having legs extending in engagement with said notches and said inner longitudinal surface of said scrubber element to hold said scrubber element, said attachment element further holding said mop strands in position on said base; and wherein said outer longitudinal surface of said scrubber element is engaged with said engagement surface to bias said scrubber element into a folded configuration folded about an axis perpendicular to said longitudinal axis whereby said inner longitudinal surface defines opposing surfaces in facing relation to each other and said opposing faces are facing away from said lower end of said handle and located substantially adjacent each other.

* * * * *